US009604238B2

(12) United States Patent
Geldard

(10) Patent No.: US 9,604,238 B2
(45) Date of Patent: Mar. 28, 2017

(54) MULTIPLE INPUT DIP TUBE

(71) Applicant: Stephen F. C. Geldard, Scottsdale, AZ (US)

(72) Inventor: Stephen F. C. Geldard, Scottsdale, AZ (US)

( * ) Notice: Subject to any disclaimer, the term of this patent is extended or adjusted under 35 U.S.C. 154(b) by 10 days.

(21) Appl. No.: 14/323,873

(22) Filed: Jul. 3, 2014

(65) Prior Publication Data

US 2016/0001312 A1 Jan. 7, 2016

(51) Int. Cl.
*B67D 7/78* (2010.01)
*B05B 15/00* (2006.01)
*B05B 11/00* (2006.01)

(52) U.S. Cl.
CPC ..... *B05B 15/005* (2013.01); *B05B 11/3011* (2013.01)

(58) Field of Classification Search
CPC .. B05B 11/0059; B05B 11/30–11/3057; B05B 15/005; B65D 83/32; B65D 1/04
USPC ..... 222/464.1–464.7, 377, 454, 211, 189.1, 222/382
See application file for complete search history.

(56) References Cited

U.S. PATENT DOCUMENTS 32,361 A * 5/1861 Hall ..... B01D 65/00 210/251
214,617 A * 4/1879 Brown ..... A47G 21/18 239/33
231,494 A * 8/1880 McCauley ..... C02F 1/003 210/266
580,527 A * 4/1897 Martin ..... C02F 1/002 210/251
1,219,937 A * 3/1917 Green ..... A61J 1/10 604/403
2,000,493 A * 5/1935 Miller ..... B05B 11/3015 222/109
2,191,447 A * 2/1940 Beardsley ..... A61J 1/1412 215/248
2,620,114 A 11/1947 Graham
2,651,546 A * 9/1953 Palm ..... A62C 3/0207 210/449
3,088,680 A * 5/1963 Fulton ..... B65D 83/32 222/376
3,209,954 A * 10/1965 Webster ..... B65D 83/32 210/431
3,221,945 A * 12/1965 Davis, Jr. ..... A61M 11/00 222/196.1

(Continued)

FOREIGN PATENT DOCUMENTS

EP 0689878 * 1/1996
KR 20100020540 * 2/2010 ..... B05B 11/3057
WO WO 2004/043611 A1 5/2004

OTHER PUBLICATIONS

KR20100020540A_MT, machine transaltion of KR 20100020540.*

(Continued)

*Primary Examiner* — Paul R Durand
*Assistant Examiner* — Randall Gruby
(74) *Attorney, Agent, or Firm* — Wentsler LLC

(57) ABSTRACT

A dip tube includes a main dip tube section and a plurality of input sections. Each input section in the plurality of input sections includes a reservoir region capped by a hydrophilic membrane. The plurality of input sections are joined to the main dip tube section at a junction.

19 Claims, 8 Drawing Sheets

(56) References Cited

U.S. PATENT DOCUMENTS 3,394,533 A * 7/1968 Li ..... B01D 53/26 55/337
3,897,968 A * 8/1975 Allen, Jr. ..... A61F 9/0061 294/1.2
D240,036 S * 5/1976 Taya ..... D23/226
4,035,303 A * 7/1977 Ufferfilge ..... B65D 83/754 210/316
4,107,043 A * 8/1978 McKinney ..... B05B 15/005 210/232
4,220,285 A * 9/1980 Gualdi ..... B05B 1/12 222/383.1
4,273,272 A * 6/1981 Blanc ..... B05B 11/0059 222/464.4
4,301,799 A * 11/1981 Pope, Jr. ..... A61J 1/1406 222/189.1
4,309,994 A * 1/1982 Grunwald ..... A61M 25/0026 604/28
4,546,905 A * 10/1985 Nandagiri ..... B65D 83/752 222/189.1
4,571,244 A * 2/1986 Knighton ..... A61M 5/38 210/446
4,830,235 A 5/1989 Miller
4,922,859 A * 5/1990 Durell ..... A01K 13/00 119/603
4,925,452 A * 5/1990 Melinyshyn ..... A61M 25/00 138/111
5,045,195 A * 9/1991 Spangrud ..... C02F 1/002 210/266
5,059,170 A * 10/1991 Cameron ..... A61M 16/0463 604/43
5,064,103 A * 11/1991 Bennett ..... A47K 5/14 222/190
5,119,974 A * 6/1992 Mann ..... B05B 11/3011 222/376
5,122,272 A * 6/1992 Iana ..... A45F 3/16 210/244
5,154,320 A * 10/1992 Bolduc ..... B65D 83/687 222/129
5,156,335 A * 10/1992 Smith ..... A47G 21/188 210/266
5,310,093 A * 5/1994 Bennett ..... B05B 7/0018 222/190
5,368,729 A * 11/1994 Stefkovich ..... B01D 15/00 210/266
5,381,961 A * 1/1995 Evans ..... B05B 11/0059 222/464.4
5,456,831 A * 10/1995 Sullivan ..... C02F 1/003 210/266
5,507,417 A * 4/1996 Webb ..... A61L 2/022 222/189.06
5,509,605 A * 4/1996 Cripe ..... C02F 1/002 210/266
5,529,244 A * 6/1996 Horvath, Jr. ..... A01C 23/042 138/44
5,562,234 A * 10/1996 Su ..... B05B 11/3018 222/321.2
5,655,714 A 8/1997 Kieffer et al.
5,718,681 A * 2/1998 Manning ..... A61J 7/0038 239/33
5,875,933 A * 3/1999 Ellion ..... B05B 11/0059 222/189.1
5,897,032 A * 4/1999 Ellion ..... B05B 11/0059 222/189.1
5,910,321 A * 6/1999 Wong ..... A47G 21/183 424/464
5,914,045 A * 6/1999 Palmer ..... C02F 1/003 210/136
5,970,210 A * 10/1999 Anthony ..... A61M 16/142 261/104
5,988,530 A * 11/1999 Rockefeller ..... B05B 11/0005 239/333
6,045,757 A * 4/2000 Moriarty ..... B01L 3/0275 422/513
6,068,163 A * 5/2000 Kihm ..... B67D 7/0238 222/189.1
6,103,108 A * 8/2000 Kohlenberg ..... C02F 1/281 137/202
6,117,394 A * 9/2000 Smith ..... B01L 3/0275 422/513
6,142,384 A * 11/2000 Shafik ..... C02F 1/002 210/282
6,202,943 B1 3/2001 Evans et al.
6,217,545 B1 * 4/2001 Haldopoulos ..... A47G 21/188 210/263
6,227,412 B1 * 5/2001 Sweeton ..... B05B 15/00 222/189.1
6,264,073 B1 7/2001 Good et al.
6,274,371 B1 * 8/2001 Colpan ..... C12N 15/101 435/259
6,371,332 B1 * 4/2002 Fox ..... A45D 27/12 222/190
6,394,319 B1 5/2002 Pucillo
6,701,975 B1 * 3/2004 Neal ..... B05B 9/03 141/18
6,776,308 B1 * 8/2004 Davis ..... B01F 5/0077 137/266
6,833,072 B1 * 12/2004 Krestine ..... B01D 35/027 210/416.1
6,871,760 B1 3/2005 Snider
7,331,489 B2 2/2008 Glynn et al.
7,722,820 B2 * 5/2010 Gjerde ..... B01J 20/285 210/198.2
8,148,169 B2 * 4/2012 Gjerde ..... B01J 20/285 210/656
8,322,576 B2 12/2012 Gioia
8,579,165 B2 11/2013 Kim
8,690,019 B2 * 4/2014 Defemme ..... B65D 47/18 137/513.5
8,852,439 B2 * 10/2014 Frauchiger ..... A47G 21/188 210/257.2
8,974,414 B2 * 3/2015 Alisantoso ..... A61M 5/1411 604/126
2001/0030201 A1 * 10/2001 Gerhardt ..... B67D 1/0004 222/333
2002/0038823 A1 * 4/2002 Tardif ..... B05B 11/3042 239/333
2002/0190079 A1 * 12/2002 Hamamoto ..... B65D 1/0215 222/105
2004/0075198 A1 * 4/2004 Schweikert ..... A61M 25/0009 264/464
2005/0279773 A1 12/2005 Byrd
2009/0071983 A1 * 3/2009 Pritchard ..... B05B 11/0043 222/211
2009/0173673 A1 7/2009 Pritchard
2011/0011895 A1 * 1/2011 Michitsuji ..... B05B 11/3001 222/382
2011/0087194 A1 * 4/2011 Carpenter ..... A61H 35/04 604/514
2012/0024910 A1 2/2012 Kim
2014/0221793 A1 * 8/2014 Hayakawa ..... A61M 1/0209 600/309
2015/0001259 A1 * 1/2015 Nguyen ..... B05B 15/005 222/464.2

OTHER PUBLICATIONS

HDX Sprayer; photos dated 2016.
Spraymaster, the Chemically Resistant Sprayer; photos dated 2016.
The Amazing Whip-it Multi-Purpose Stain Remover; photos dated 2016.
Zep Professional Sprayer; photos dated 2016.

* cited by examiner

MULTIPLE INPUT DIP TUBE

BACKGROUND

Spray bottles, pump action containers and similar hand held consumer and industrial fluid delivery devices typically include a dip tube to transport fluid from the bottom of a container to a nozzle head. The fluid can be, for example, a household cleaning solution, plant fertilizer, perfume, suntan lotion and so on. The fluid enters the dip tube at or near a bottom of a container holding the fluid. The fluid is pumped through the dip tube, then to and out the nozzle head to a desired location.

DESCRIPTION OF THE EMBODIMENT

A single input dip tube is only able to capture liquid from one location within a container. This can be problematic, for example, when the container is tilted and the fluid pools at a location below a current input location of the dip tube. A dip tube with multiple inputs can allow more efficient use of fluid within a container, especially when the container is tilted during use.

Figure 1:
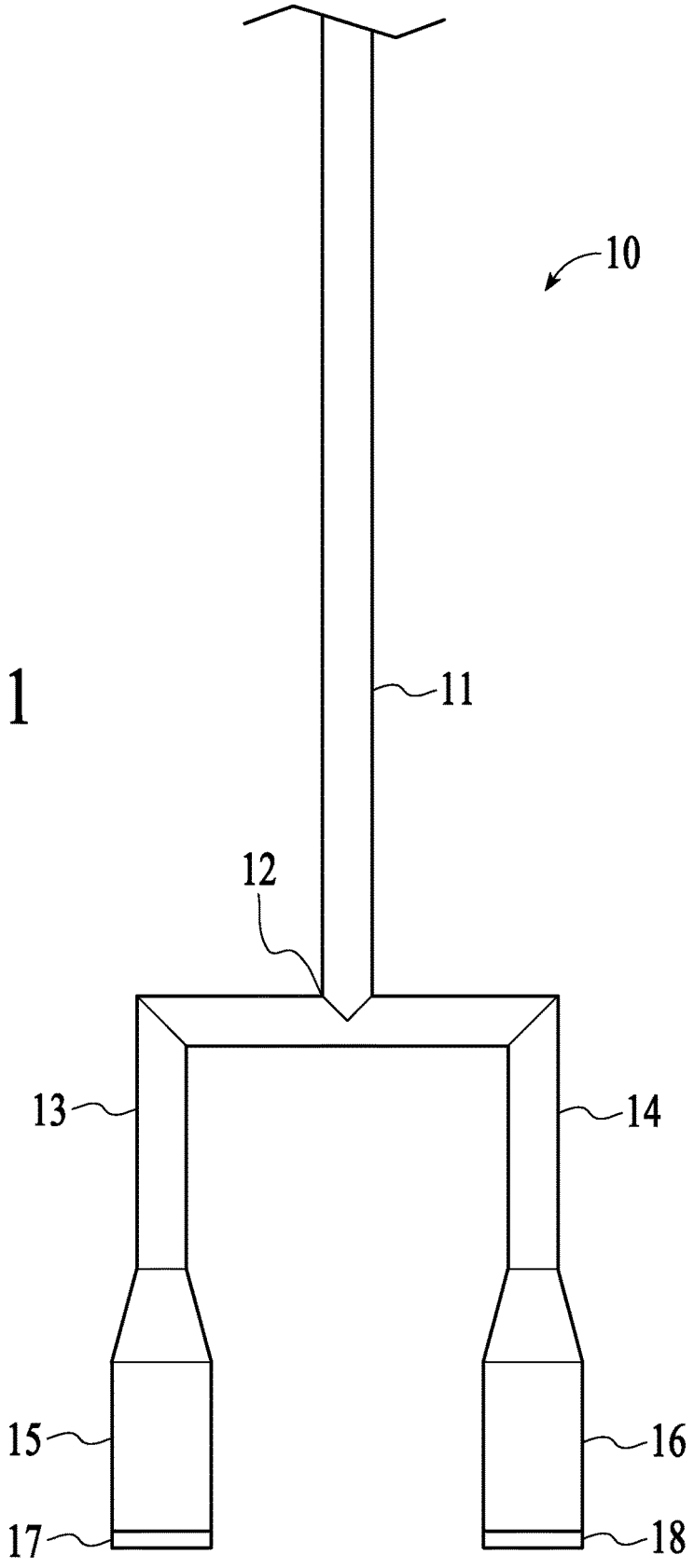
FIG. 1 shows a multiple input dip tube in accordance with an implementation.

For example, FIG. 1 shows a dip tube 10 with multiple inputs. A main dip tube section 11 at a junction 12, divides into an input section 13 and an input section 14. For example, dip tube 10 is formed or molded in one piece using a flexible material, such as high-density polyethylene (HDPE) plastic.

A hydrophilic membrane 17 prevents air intake to a reservoir region 15 when fluid does not reach to a location of hydrophylic membrane 17. When fluid does reach to the location of hydrophilic membrane 17, fluid can pass through hydrophilic membrane 17 to reach reservoir region 15. Likewise, a hydrophilic membrane 18 prevents air intake to a reservoir region 16 when fluid does not reach to a location of hydrophylic membrane 18. When fluid does reach to the location of hydrophilic membrane 18, fluid can pass through hydrophilic membrane 18 to reach reservoir region 16.

Hydrophilic membrane 17 and hydrophilic membrane 18 each allow low viscosity fluid across their surface while at the same time blocking any air from entering the system. The fluid is essentially degassed. Hydrophilic membranes are manufactured by General Electric (GE) and other companies in various materials including Nylon, Mixed Cellulose Esters (MCE Nitrocellulose), Cellulose Acetate, polytetrafluoroethylene (PTFE), Polysulphone and so on.

Hydrophilic membrane 17 and hydrophilic membrane 18 decrease fluid flow into input section 13 and input section 14, respectively. The increased intake area, and thus the increased intake capability, of reservoir region 15 and reservoir region 16 is implemented to compensate for the decreased fluid flow through hydrophilic membrane 17 and hydrophilic membrane 18, respectively. While FIG. 1 shows a cross section of input section 13 being increased at reservoir region 15 and a cross section of input section 14 being increased at reservoir region 16 in order to compensate for the decreased fluid flow through hydrophilic membrane 17 and hydrophilic membrane 18, respectively, this is not necessary for applications where fluid flow through hydrophilic membrane 17 and hydrophilic membrane 18 is sufficient without increasing the cross sections at reservoir regions 15 and reservoir region 16. In cases where the cross sections at reservoir regions 15 and reservoir region 16 are not widened, the cross sections at reservoir regions 15 and reservoir region 16 can remain the same as for other locations within input section 13 and input section 14, respectively.

When reservoir region 15 and reservoir region 16 are both immersed in fluid and thus able to draw fluid out of a container, total flow through main dip tube section 11 increases which allows for a more even spray of a connected spray nozzle.

Figure 2:
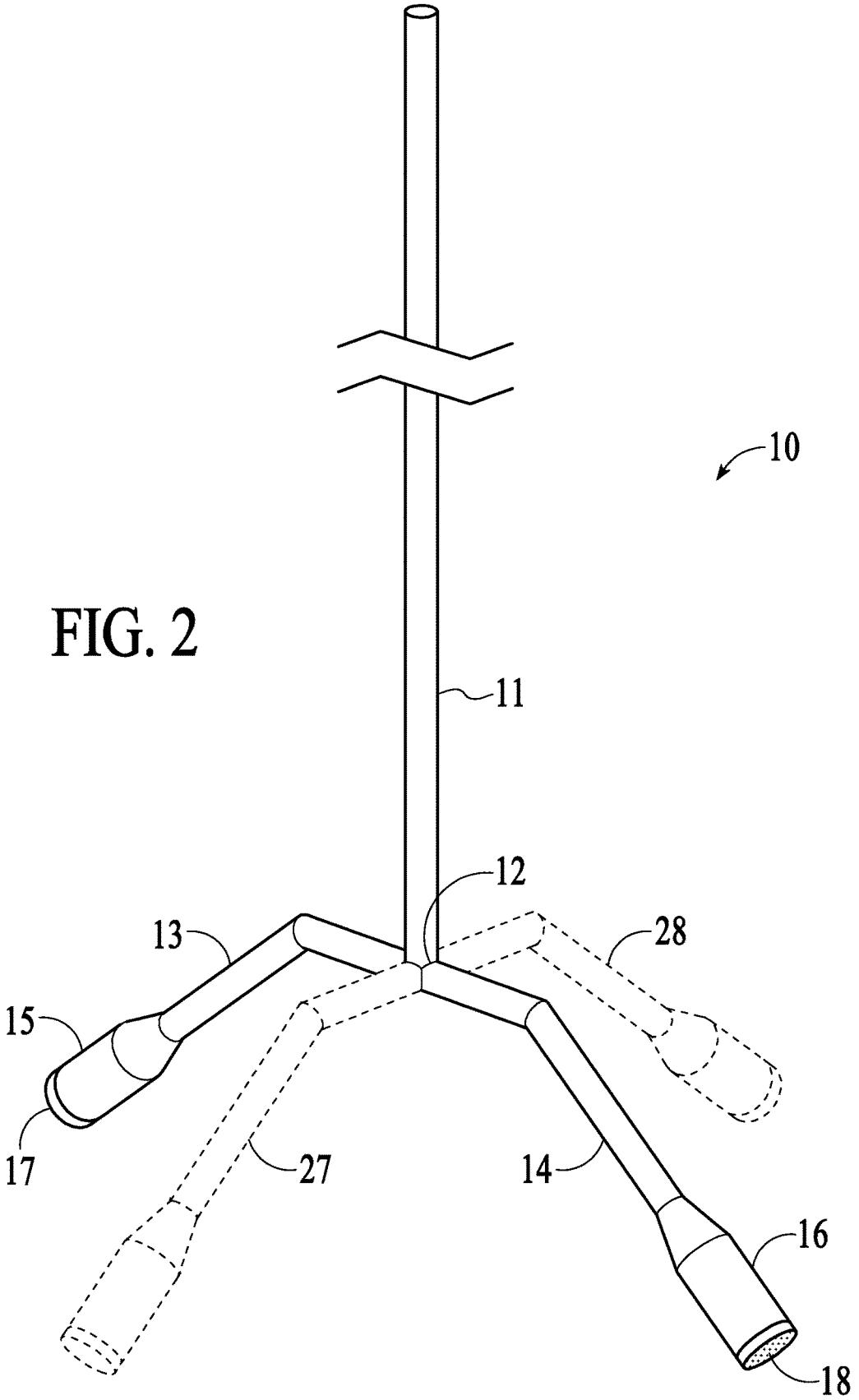
FIG. 2 shows the multiple input dip tube shown in FIG. 1 with the inputs extended in accordance with an implementation.

FIG. 2 shows input section 13 and input section 14 spread to the accommodate dimensions of a container. This spreading accommodates contours of a container in which dip tube 10 is placed. While FIG. 1 shows dip tube 10 having two inputs, additional inputs can be added. This is illustrated in FIG. 2 by dashed lines indicating where an input region 27 and an input region 28 could be added.

Figure 3:
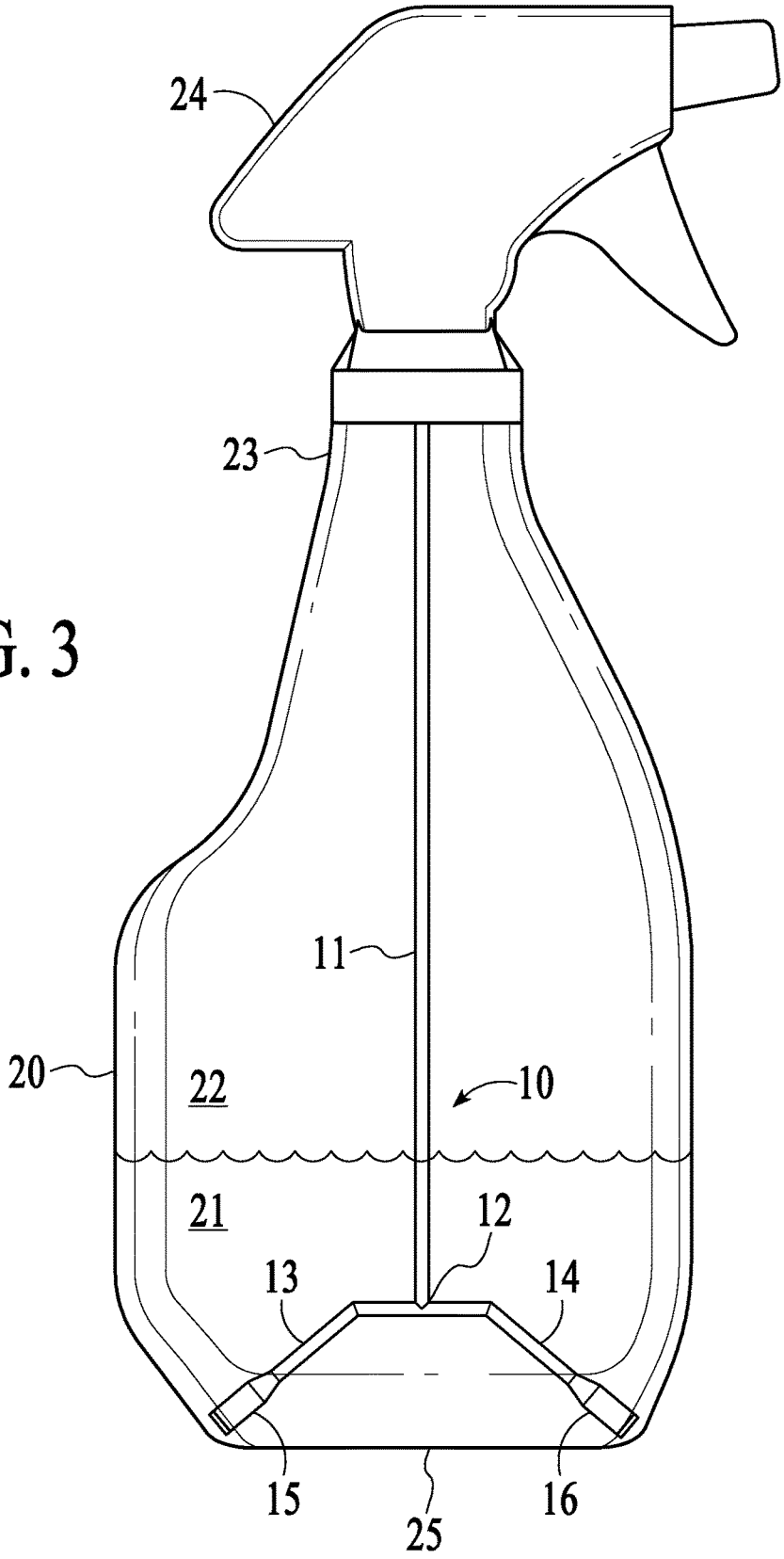
FIG. 3 shows a multiple input dip tube within a container and connected to a pump nozzle head in accordance with an implementation.

FIG. 3 shows main dip tube section 11 placed in a container 20. As dip tube reaches a bottom 25 of container, input section 13 and input section 14 are spread to reach bottom corners of container 20. When container 20 is upright both the multiple input section 13 and input section 14 are spread as the bottom of reservoir region 15 and reservoir region 16 encounter bottom 25 of container 20 and main dip tube section 11 continues to be pushed down. Pump nozzle 24 is attached to a top opening section 23 of container 20 and to main dip tube section 11. Container 20 is partially filled with fluid 21. A remainder of volume of container 20 is filled with air 22. The size, shape and flexibility of dip tube 10 is configured to allow easy entrance to container 20 through top opening section 23.

Figure 4:
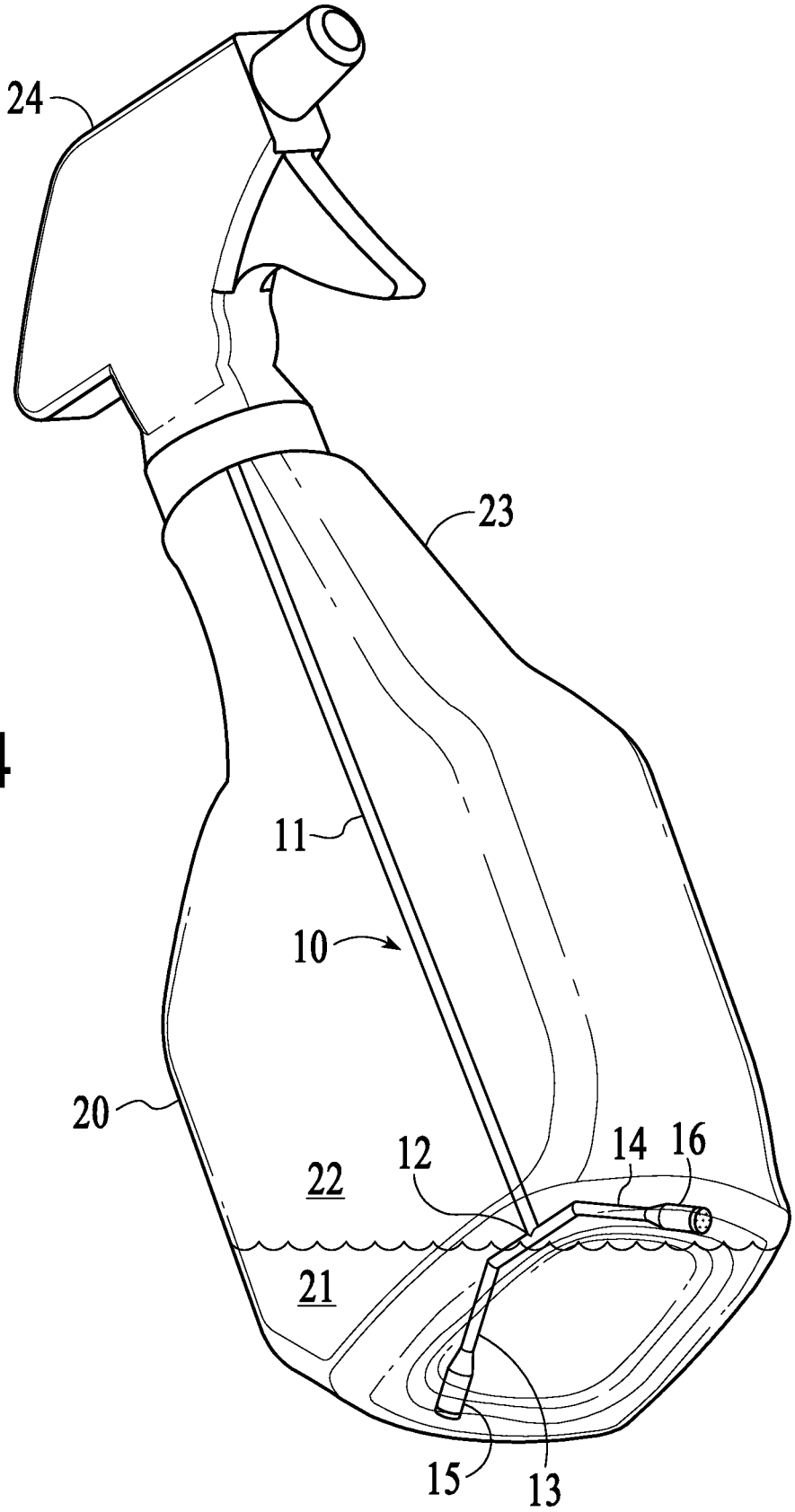
FIG. 4 shows a multiple input dip tube within a tilted container and connected to a pump nozzle head in accordance with an implementation.

As fluid level is decreased and container 20 is tilted, for example when used, fluid 21 may cover one but not both of reservoir region 15 and reservoir region 16. This illustrated by FIG. 4 where container 10 has been tilted so that fluid 21 covers reservoir region 15 but not reservoir region 16. A pump nozzle head 24 pumps fluid through dip tube 10, hydrophilic membrane 18 prevents air 22 from entering reservoir region 16. Fluid 21 pass through hydrophilic membrane 17 into reservoir region 15, through input section to main dip tube section 11 and out of container 20 through pump nozzle head 24.

This allows container 20 to be held at an angle than change fluid angle and level within container 20 while still providing fluid through dip tube 10 to pump nozzle head 24. This also allows fluid 21 to be used efficiently and completely while simultaneously adding flexibility at allowable angles container 20 can be held as fluid level decreases.

Figure 5:
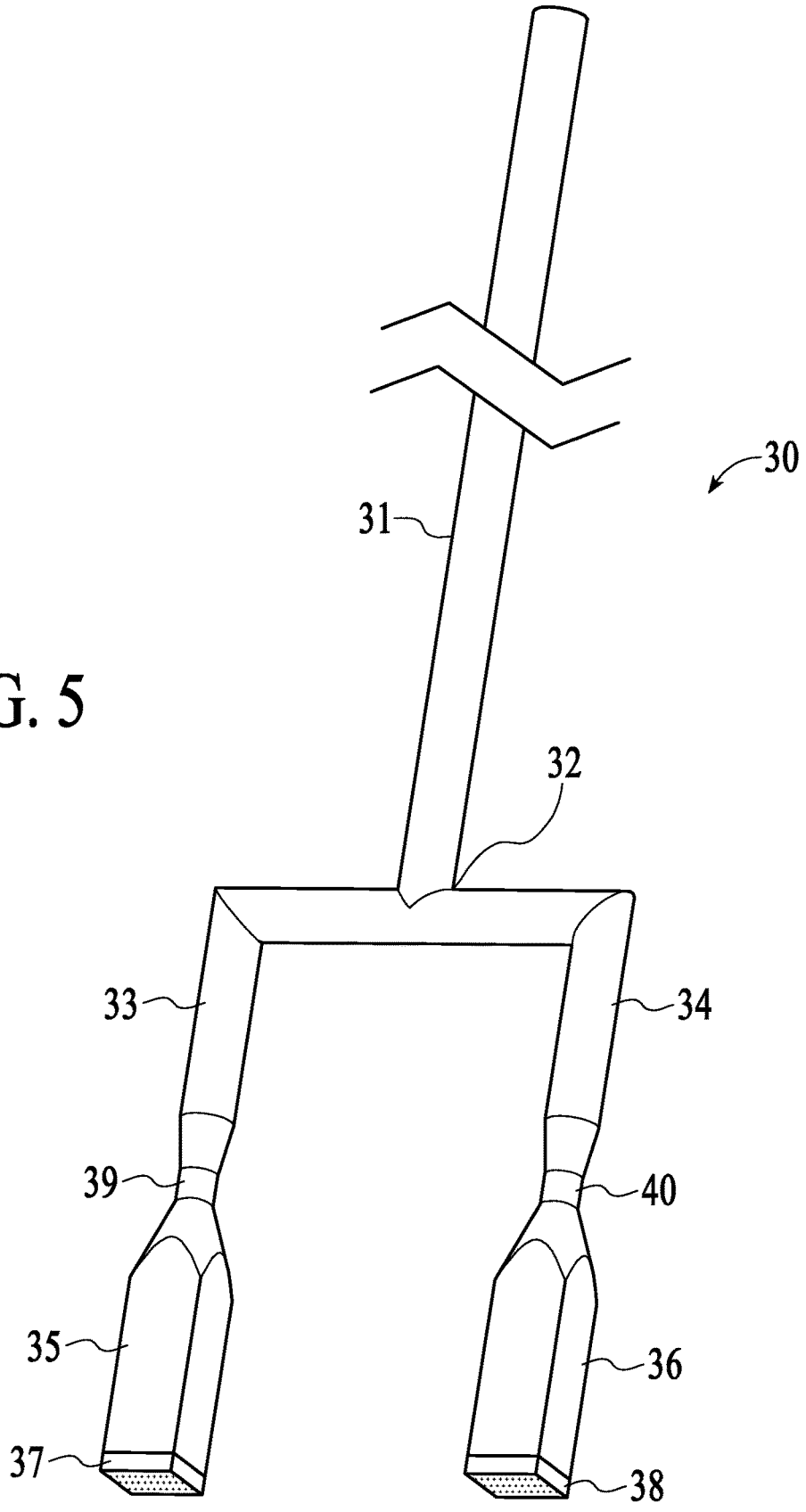
FIG. 5 shows a multiple input dip tube within where each input has a membrane, a reservoir region and a venturi in accordance with an implementation.

FIG. 5 shows a multiple input dip tube within where each input section has a venturi section where a diameter of the input section is narrowed. Specifically, FIG. 5 shows a dip tube 30 with multiple inputs. A main dip tube section 31 at a junction 32, divides into an input section 33 and an input section 34. A hydrophilic membrane 37 prevents air intake to a reservoir region 35 when fluid does not reach to a location of hydrophilic membrane 37. When fluid does reach to the location of hydrophilic membrane 37, fluid can pass through hydrophilic membrane 37 to reach reservoir region 35. Likewise, a hydrophilic membrane 38 prevents air intake to a reservoir region 36 when fluid does not reach to a location of hydrophilic membrane 38. When fluid does reach to the location of hydrophilic membrane 38, fluid can pass through hydrophilic membrane 38 to reach reservoir region 36. As shown in FIG. 5, a cross sectional flow area 36*a* of the reservoir region 36 taken perpendicular to a flow direction of the reservoir region 36 is greater than a cross sectional flow area 34*a* of a downstream portion of the input section 34 taken perpendicular to the flow direction of the input section 34.

A venturi that includes a narrow section 39 of input section 33 causes a pressure drop that increases the flow of fluid through input section 33 and compensates for the loss of flow across membrane 37 into reservoir region 35. The venturi also lessens turbulence, resistance and back flow as fluid crosses hydrophilic membrane 37 into reservoir region 35. Likewise, a venturi that includes narrow section 40 of input section 34 causes a pressure drop that increases the flow of fluid input 34 and compensates for the loss of flow across membrane 38 into reservoir region 36. This venturi also lessens turbulence, resistance and back flow as fluid crosses hydrophilic membrane 38 into reservoir region 36.

Figure 6:
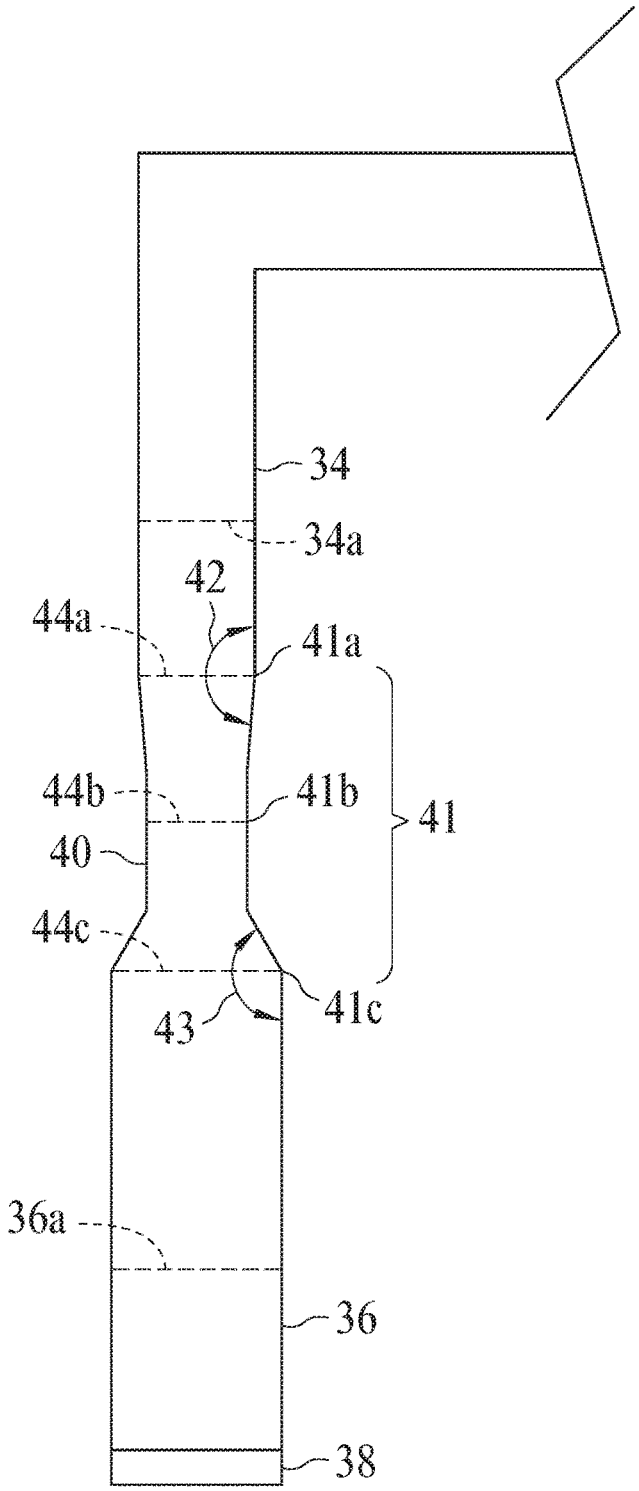
FIG. 6 shows an input that has a membrane, a reservoir region and a venturi in accordance with an implementation.

FIG. 6 provides additional information about a venturi 41 that includes narrow section 40. As shown in FIG. 6, the venturi (indicated by bracket 41) is positioned downstream from the reservoir region 36. For example, as shown in FIG. 6, in constructing venturi 41, angle 42 is greater than angle 43. Furthermore, as shown in FIG. 6, the venturi 41 includes a venturi region with a first venturi portion 41*a* with a first cross sectional flow area 44*a* taken perpendicular to a flow direction of the venturi region, a second venturi portion 41*b* with a second cross sectional flow area 44*b* taken perpendicular to the flow direction of the venturi region, and a third venturi portion 41*c* with a third cross-sectional flow area 44*c* taken perpendicular to the flow direction of the venturi region. As shown in FIG. 6, the second venturi portion 41*b* is positioned between the first venturi portion 41*a* and the third venturi portion 41*c*. As still further illustrated in FIG. 6, the second cross sectional flow area 44*b* is less than the first cross sectional flow area 44*a*, and the second cross sectional flow area 44*b* is less than the third cross sectional flow area 44*c*. As still further illustrated in FIG. 6, the first cross sectional flow area 44*a* is positioned downstream along the flow direction of the venturi region relative to the third cross sectional flow area 44*c* and the first cross sectional flow area 44*a* is less than the third cross sectional flow area 44*c*. As further shown in FIG. 6, the cross sectional flow area 34*a* of the downstream portion of the input section 34 is less than the third cross sectional flow area 44*c* of the third venturi portion 41*c*.

Figure 7:
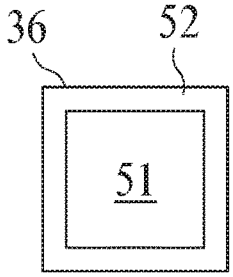
FIG. 7 shows a square cross section of a reservoir region shape in accordance with an implementation.

FIG. 7 shows an example of a cross section shape for reservoir region 36. In the example shown in FIG. 7, the cross section of reservoir region 36 is shown to have square corners with a wall region 52 and an inner passage 51. Wall region 52 can, for example, include either a waterproof adhesive or a waterproof adhesive and gasket where membrane 38 is joined to reservoir region 36. A square shape at the open end of reservoir region 36 can allow for more efficient use of membrane material when manufacturing.

Figure 8:
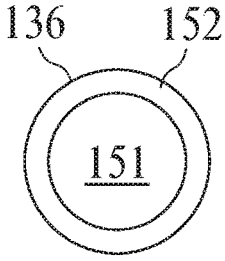
FIG. 8 shows a circular cross section of a reservoir region shape in accordance with an implementation.

FIG. 8 shows an alternative example of a cross section shape for a reservoir region. In the example shown in FIG. 8, the cross section of a reservoir region 136 is rounded with a wall region 152 and an inner passage 151. Wall region 152 can also, for example, include either a waterproof adhesive or a waterproof adhesive and gasket where a membrane is joined to reservoir region 136.

Figure 9:
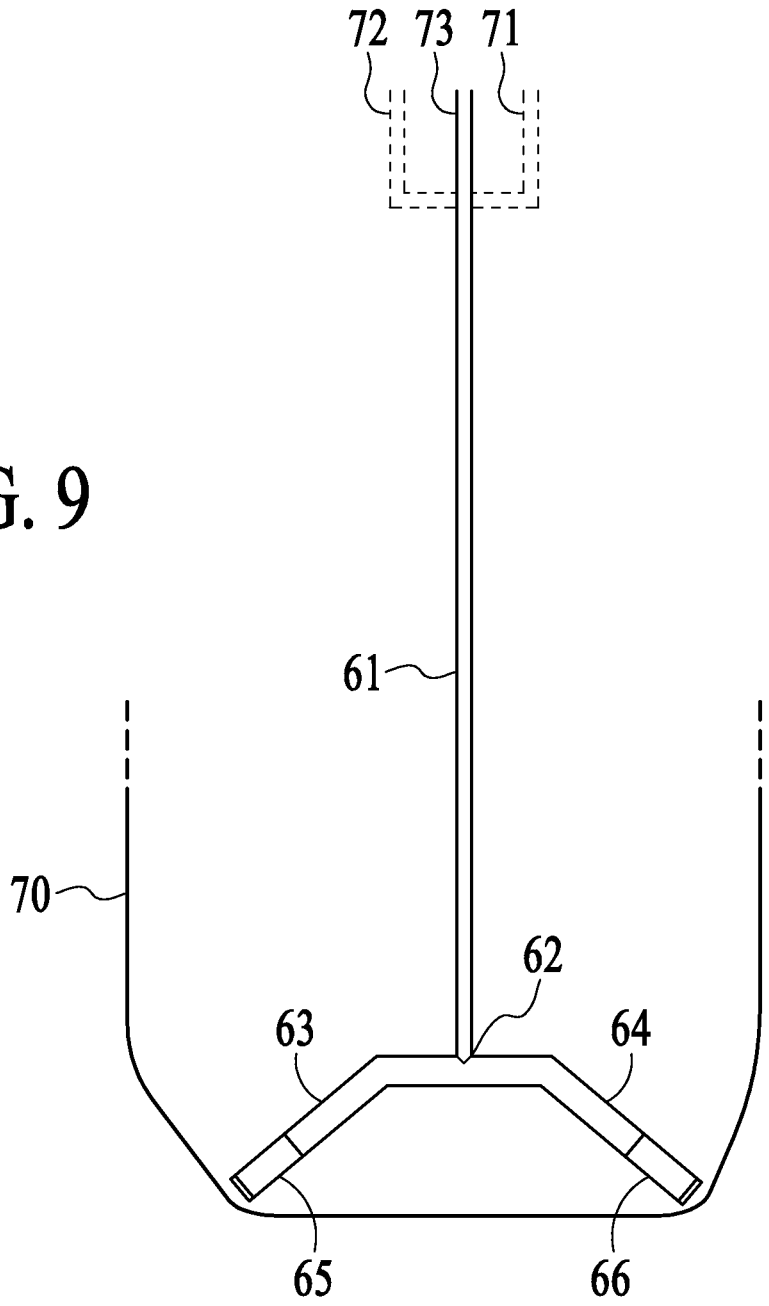
FIG. 9 shows a multiple input dip tube within a container having various potential configurations for connection to a pump nozzle head in accordance with an implementation.

FIG. 9 shows a multiple input main dip tube section 61 within a container 70. A main dip tube section 61 at a junction 62, divides into an input section 63 and an input section 64. A hydrophilic membrane 65, shaped as a cap, prevents air intake to input section 63 when fluid does not reach to a location of hydrophylic membrane 65. When fluid does reach to the location of hydrophilic membrane 65, fluid can pass through hydrophilic membrane 65 to reach input section 63. Likewise, a hydrophilic membrane 66 prevents air intake to input section 64 when fluid does not reach to a location of hydrophylic membrane 68. When fluid does reach to the location of hydrophilic membrane 66, fluid can pass through hydrophilic membrane 66 to reach input section 64. For example, in the implementation shown in FIG. 9, all of input section 63 acts a reservoir and all of input section 64 acts as another reservoir.

Various configuration options at a top of main dip tube section 61 are illustrated by FIG. 9. A straight configuration 73 is issued when a pump nozzle to be connected to main dip tube section 61 is configured to receive a straight configuration. When a pump nozzle is configured to receive an offset dip tube configuration, the top of main dip tube section 61 is configured to conform to the expected offset such as illustrated by an offset configuration 71 or an offset configuration 72.

While various embodiments of a dip tube with two inputs have been shown herein, the number of inputs can differ dependent upon the intended uses and preferences of the user or designer.

Figure 10:
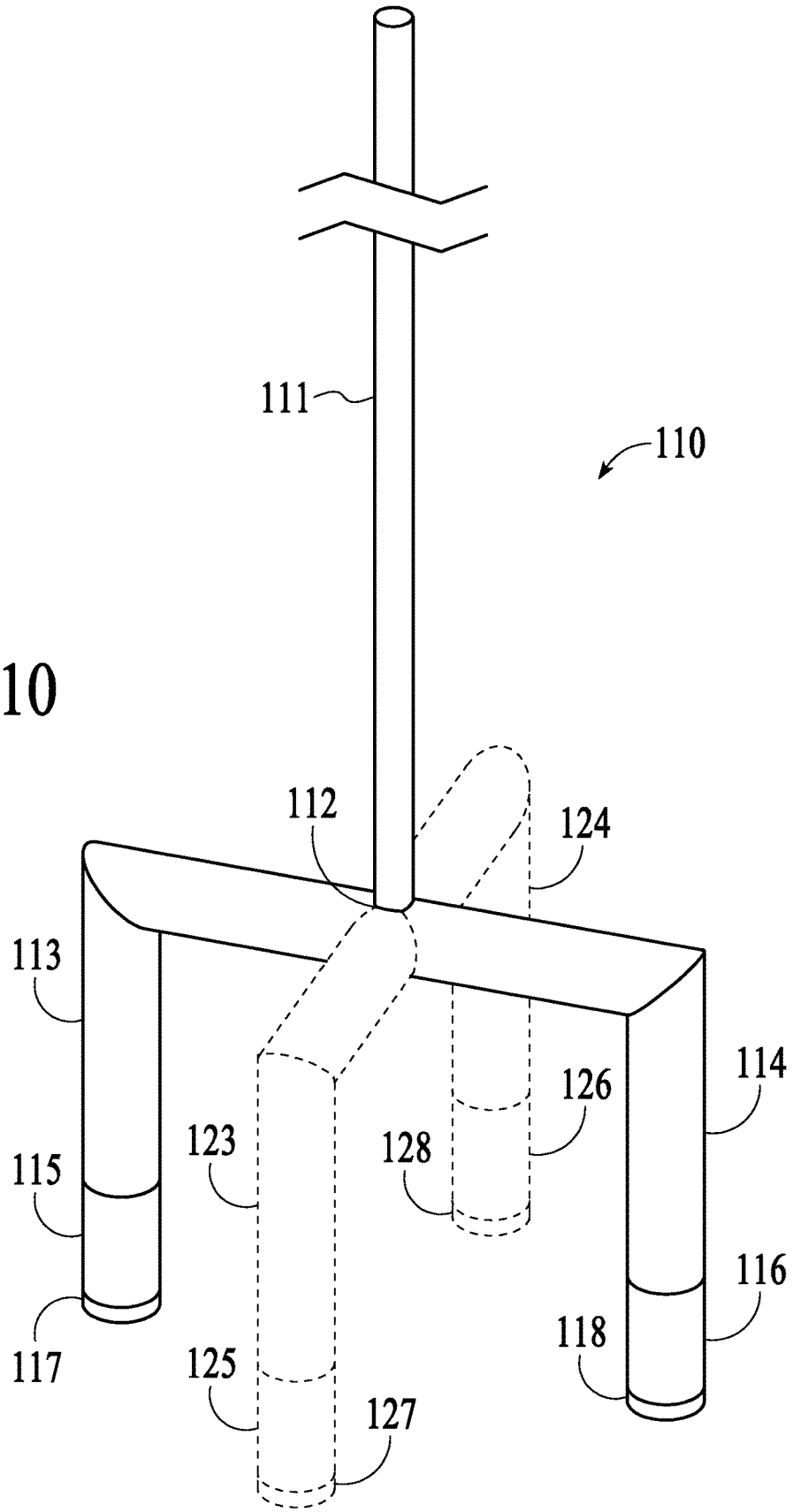
FIG. 10 shows a multiple input dip tube in accordance with another implementation.

For example, FIG. 10 shows a dip tube 110 with four inputs. A main dip tube section 111 at a junction 112, divides into an input section 113, an input section 114, an input section 123 and an input section 124. A hydrophilic membrane 117 prevents air intake to a reservoir region 115 when fluid does not reach to a location of hydrophylic membrane 117. When fluid does reach to the location of hydrophilic membrane 117, fluid can pass through hydrophilic membrane 117 to reach reservoir region 115. Likewise, a hydrophilic membrane 118 prevents air intake to a reservoir region 116 when fluid does not reach to a location of hydrophylic membrane 118. When fluid does reach to the location of hydrophilic membrane 118, fluid can pass through hydrophilic membrane 118 to reach reservoir region 116.

Additional optional input regions are shown in dashed lines. Specifically, a hydrophilic membrane 127 prevents air intake to a reservoir region 125 when fluid does not reach to a location of hydrophylic membrane 127. When fluid does reach to the location of hydrophilic membrane 127, fluid can pass through hydrophilic membrane 127 to reach reservoir region 125. Likewise, a hydrophilic membrane 128 prevents air intake to a reservoir region 126 when fluid does not reach to a location of hydrophylic membrane 128. When fluid does reach to the location of hydrophilic membrane 128, fluid can pass through hydrophilic membrane 128 to reach reservoir region 126.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A dip tube comprising:

a main dip tube section;

a first input section capped by a first hydrophilic membrane to prevent air from entering into the first input section during a use of the dip tube; and a second input section capped by a second hydrophilic membrane to prevent air from entering into the second input section during the use of the dip tube, wherein the first input section and the second input section are joined to the main dip tube section;

wherein at least one of the first input section and the second input section includes a venturi region;

wherein the venturi region includes a first venturi portion with a first venturi cross sectional flow area taken perpendicular to a flow direction of the venturi region, a second venturi portion with a second venturi cross sectional flow area taken perpendicular to the flow direction of the venturi region, and a third venturi portion with a third venturi cross-sectional flow area taken perpendicular to the flow direction of the venturi region, wherein the second venturi portion is positioned between the first venturi portion and the third venturi portion, the second venturi cross sectional flow area is less than the first venturi cross sectional flow area, the second venturi cross sectional flow area is less than the third venturi cross sectional flow area, the first venturi cross sectional flow area is less than the third cross sectional flow area, and the first cross sectional flow area is positioned downstream along the flow direction relative to the third cross sectional flow area.

2. The dip tube of claim 1, wherein the first input section includes a first reservoir region that is capped by the first hydrophilic membrane, and the second input section includes a second reservoir region that is capped by the second hydrophilic membrane.

3. The dip tube of claim 2, wherein a cross sectional flow area of the first reservoir region taken perpendicular to a flow direction of the first input section is greater than a cross sectional flow area of a downstream portion of the first input section taken perpendicular to a flow direction of the first input section, and a cross sectional flow area of the second reservoir region taken perpendicular to a flow direction of the second input section is greater than a cross sectional flow area of a downstream portion of the second input section taken perpendicular to a flow direction of the second input section.

4. The dip tube of claim 2, wherein a cross section of the first input section where the first reservoir region is capped by the first hydrophilic membrane has approximately square corners, and a cross section of the second input section where the second reservoir region is capped by the second hydrophilic membrane has approximately square corners.

5. The dip tube of claim 2, wherein a cross section of the first input section where the first reservoir region is capped by the first hydrophilic membrane is rounded, and a cross section of the second input section where the second reservoir region is capped by the second hydrophilic membrane is rounded.

6. The dip tube of claim 1, further comprising a third input section capped by a third hydrophilic membrane to prevent air from entering into the third input section during the use of the dip tube, wherein the third input section is joined to the main dip tube section.

7. The dip tube of claim 6, further comprising a fourth input section capped by a fourth hydrophilic membrane to prevent air from entering into the fourth input section during the use of the dip tube, wherein the fourth input section is joined to the main dip tube section.

8. The dip tube of claim 1, wherein a cross sectional flow area of a downstream portion of the first input section taken perpendicular to a flow direction of the first input section is less than the third cross sectional flow area of the third venturi portion.

9. A dip tube comprising:

a main dip tube section;

a first input section joined to the main dip tube section, the first input section including a first reservoir region that is capped by a first hydrophilic membrane to prevent air from entering into the first input section during a use of the dip tube, wherein a cross sectional flow area of the first reservoir region taken perpendicular to a flow direction of the first input section is greater than a cross sectional flow area of a downstream portion of the first input section taken perpendicular to a flow direction of the first input section; and a second input section joined to the main dip tube section, the second input section including a second reservoir region that is capped by a second hydrophilic membrane to prevent air from entering into the second input section during the use of the dip tube, wherein a cross sectional flow area of the second reservoir region taken perpendicular to a flow direction of the second input section is greater than a cross sectional flow area of a downstream portion of the second input section taken perpendicular to a flow direction of the second input section, wherein each of the first input section and the second input section includes a venturi region including a first venturi portion with a first venturi cross sectional flow area taken perpendicular to a flow direction of the venturi region, a second venturi portion with a second venturi cross sectional flow area taken perpendicular to the flow direction of the venturi region, and a third venturi portion with a third venturi cross-sectional flow area taken perpendicular to the flow direction of the venturi region, wherein the second venturi portion is positioned between the first venturi portion and the third venturi portion, the second venturi cross sectional flow area is less than the first venturi cross sectional flow area, the second venturi cross sectional flow area is less than the third venturi cross sectional flow area, the first venturi cross sectional flow area is less than the third cross sectional flow area, and the first cross sectional flow area is positioned downstream along the flow direction relative to the third cross sectional flow area.

10. The dip tube of claim 9, wherein a cross section of the first input section where the first reservoir region is capped by the first hydrophilic membrane is rounded or has approximately square corners, and a cross section of the second input section where the second reservoir region is capped by the second hydrophilic membrane is rounded or has approximately square corners.

11. The dip tube of claim 9, further comprising a third input section capped by a third hydrophilic membrane to prevent air from entering into the third input section during the use of the dip tube, wherein the third input section is joined to the main dip tube section.

12. The dip tube of claim 11, further comprising a fourth input section capped by a fourth hydrophilic membrane to prevent air from entering into the fourth input section during the use of the dip tube, wherein the fourth input section is joined to the main dip tube section.

13. The dip tube of claim 9, wherein a cross sectional flow area of a downstream portion of the first input section taken perpendicular to a flow direction of the first input section is less than the third cross sectional flow area of the third venturi portion.

14. A fluid delivery device comprising:

a container defining an interior area;

a pump nozzle head; and a dip tube attached to the pump nozzle head and extending within the interior area of the container, the dip tube comprising a main dip tube section, a first input section capped by a first hydrophilic membrane to prevent air from entering into the first input section during a use of the fluid delivery device, and a second input section capped by a second hydrophilic membrane to prevent air from entering into the second input section during the use of the fluid delivery device, wherein the first input section and the second input section are each joined to the main dip tube section, and the first hydrophilic membrane and the second hydrophilic membrane are each positioned within an end portion of the interior area of the container;

wherein at least one of the input sections includes a venturi region;

wherein the venturi region includes a first venturi portion with a first venturi cross sectional flow area taken perpendicular to a flow direction of the venturi region, a second venturi portion with a second venturi cross sectional flow area taken perpendicular to the flow direction of the venturi region, and a third venturi portion with a third venturi cross-sectional flow area taken perpendicular to the flow direction of the venturi region, wherein the second venturi portion is positioned between the first venturi portion and the third venturi portion, the second venturi cross sectional flow area is less than the first venturi cross sectional flow area, the second venturi cross sectional flow area is less than the third venturi cross sectional flow area, the first venturi cross sectional flow area is less than the third cross sectional flow area, and the first cross sectional flow area is positioned downstream along the flow direction relative to the third cross sectional flow area.

15. The fluid delivery device of claim 14, wherein the first input section includes a first reservoir region that is capped by the first hydrophilic membrane, and the second input section includes a second reservoir region that is capped by the second hydrophilic membrane.

16. The fluid delivery device of claim 15, wherein a cross sectional flow area of the first reservoir region taken perpendicular to a flow direction of the first input section is greater than a cross sectional flow area of a downstream portion of the first input section taken perpendicular to a flow direction of the first input section, and cross sectional flow area of the second reservoir region taken perpendicular to a flow direction of the second input section is greater than a cross sectional flow area of a downstream portion of the second input section taken perpendicular to a flow direction of the second input section.

17. The fluid delivery device of claim 14, further comprising a third input section capped by a third hydrophilic membrane to prevent air from entering into the third input section during the use of the dip tube, wherein the third input section is joined to the main dip tube section.

18. The fluid delivery device of claim 17, further comprising a fourth input section capped by a fourth hydrophilic membrane to prevent air from entering into the fourth input section during the use of the dip tube, wherein the fourth input section is joined to the main dip tube section.

19. The fluid delivery device of claim 14, wherein a cross sectional flow area of a downstream portion of the first input section taken perpendicular to a flow direction of the first input section is less than the third cross sectional flow area of the third venturi portion.

* * * * *